United States Patent [19]

Sonnenschein

[11] Patent Number: 4,962,335

[45] Date of Patent: Oct. 9, 1990

[54] DEUTERIUM LAMP VOLTAGE SUPPLY MEANS

[76] Inventor: Armin K. Sonnenschein, 27 Natmark Ct., Woodcliff Lake, N.J. 07675

[21] Appl. No.: 330,778

[22] Filed: Mar. 30, 1989

[51] Int. Cl.[5] ..... H05B 41/19

[52] U.S. Cl. ..... 315/335; 315/330; 315/60; 315/58

[58] Field of Search ..... 315/330, 335, 60, 58

[56] References Cited

U.S. PATENT DOCUMENTS

| | | | |
|---|---|---|---|
| 2,809,317 | 10/1957 | Meili | 315/335 X |
| 2,883,584 | 4/1959 | Hill | 315/335 |
| 3,634,718 | 1/1972 | Larson | 315/330 X |
| 3,900,761 | 8/1975 | Freese et al. | 315/330 X |
| 4,007,397 | 2/1977 | Lake | 315/335 X |

OTHER PUBLICATIONS

Hamamatsu brochure, "Deuterium Lamps, UV Light Sources for Spectroscopy" dated prior to date of invention.

*Primary Examiner*—Eugene R. LaRoche
*Assistant Examiner*—Do Hyum Yoo
*Attorney, Agent, or Firm*—Samuelson & Jacob

[57] ABSTRACT

A deuterium lamp starting circuit utilizing the arc-defining aperture cage of the lamp as the arc-starting electrode to enable the application of a positive, low starting voltage simultaneously with the application of the filament voltage. This positive, low starting voltage is applied to the cage which operates as a starting electrode. After the anode to cathode arc strikes and the anode voltage decreases below the cutoff level, current between the cage and the cathode is reduced and the current flows between the cathode and the anode of the tube.

13 Claims, 4 Drawing Sheets

DEUTERIUM LAMP VOLTAGE SUPPLY MEANS

The invention relates to voltage supply means for deuterium lamps and in particular to such supply means which will produce plasma glow at voltages lower than those which are required at present.

Deuterium lamps are used to supply light for use in chromatic analysis requiring a broad wave length spectrum of energy in the ultraviolet range (about 160 nm to 400 nm).

The deuterium lamp systems, which are presently used, require that application of the anode voltage take place about 30 seconds to one minute after the voltage has been applied to the heater element. The heater element, in this context, means either the heater for an indirectly heated cathode or a directly heated cathode (filament). This delay in the application of the full anode voltage is necessary in order to prevent sputtering of the heater coating.

Accordingly, it is an important object of the invention to provide means for striking a lower voltage (20 V–30 V) arc between the cathode and the lamp cage. This starts the plasma glow within the tube and permits the use of lower anode voltages (120 V–160 V) to strike the main arc between the cathode and the anode through the cage aperture so that full plasma glow is achieve.

It is a further object of the invention to provide means for applying the heater voltage and the lower cage and anode voltages simultaneously to permit fast starting of the plasma glow.

It is another object of the invention to provide a small, low power-consuming starting circuit which may be mounted directly at the base of the lamp to thereby provide for using the invention with most existing deuterium lamp power supplies.

It is a still further object of the invention to provide a small low power-consuming starting circuit which may be mounted in an existing power supply.

It is yet another object of the invention to provide such a starting circuit which is safer because the starting voltage is much lower than that required in the currently used systems.

It is also an object of the invention to provide a system which will permit small, arc-defining apertures to be used without the need for the excessively high starting voltages of the order of several hundred volts which are currently used.

The invention is directed toward providing means for utilizing lower anode voltages in deuterium lamp circuits while at the same time obtaining better operational stability. Preferably, the circuit employed utilizes a switching circuit connected between the lamp anode and its cage. The switching circuit comprises means for applying a low positive voltage to the cage. After the arc strikes and the plasma glow within the lamp grows, the electron flow between the cathode and the anode is accelerated. At this point, the switching circuit reduces the current flowing to the cage to about zero and the full current is applied to the anode so that maximum plasma glow is obtained. Because the invention permits the cathode heater and anode voltages to be applied simultaneously, it is possible to achieve a pulsed light output by turning the positive voltage on and off without causing sputtering or other lamp damage. The cage is positioned between the anode and the cathode to prevent undesired current flow in the lamp.

The objects, advantages, uses and features of the invention will be apparent to those skilled in the art when taken in conjunction with the following discussion and the accompanying drawing wherein.

Figure 1:
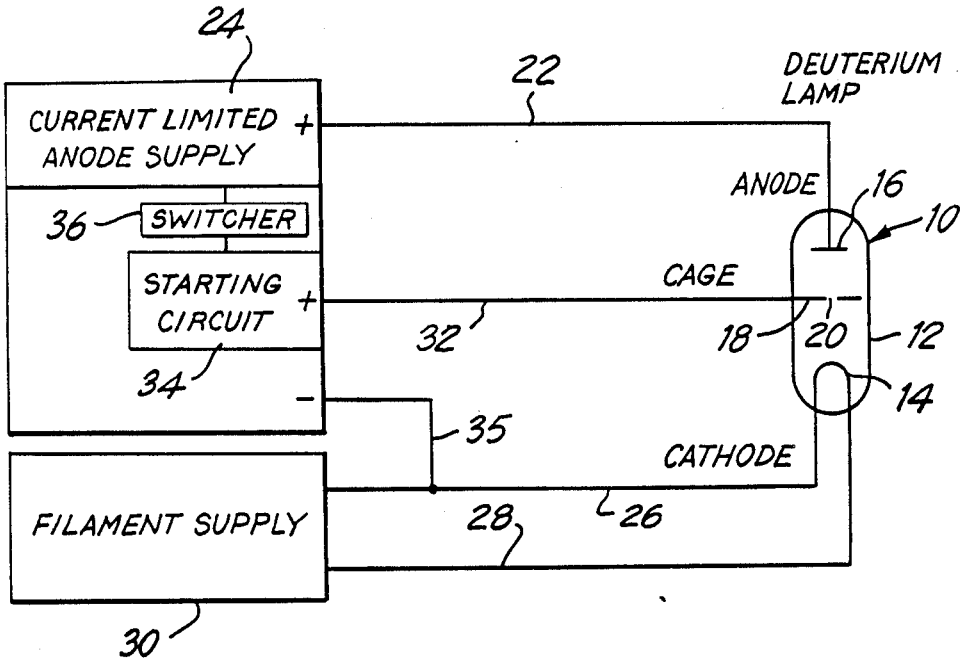
FIG. 1 is a block diagram of the invention wherein the starting circuit is associated with the current limited anode supply.

In the drawing wherein there are shown preferred embodiments of the invention and like numerals are used to designate like parts throughout the same, the numeral 10 designates generally, a deuterium lamp which is used with the invention (FIG. 1). Lamp 10 comprises an envelope 12 and a cathode 14, an anode 16 and a cage 18 mounted inside envelope 12. Envelope 12 is filled with a suitable gas such as deuterium and the envelope is sealed.

Cage 18 is preferably formed of metal and is provided with an arc defining aperture 20. Aperture 20 is of the order of 0.5 mm in diameter and serves to concentrate the flow of the electrons toward the center of the anode surface. A wire 22 is connected to anode 16 and projects through the envelope 12 to permit the making of the necessary electrical connection to a current limited anode supply 24. Two wires 26 and 28 are connected to the filament or heater and project outside the envelope 12 to permit electrical connection to the filament supply 30.

While the drawing shows that a directly-heated cathode or filament is used, it is also within the scope of the invention to use an indirectly heated cathode. With such a construction the cathode may be connected to one side of the filament within the lamp. Under such conditions, that side of the filament will be connected to the common or equipment ground.

The cage 18 (FIG. 1) is connected within the lamp to a wire 32 which projects outside the envelope so as to be connected to a starting circuit 34. The starting circuit 34 supplies a low, positive, current-limited voltage of the order of 30 or so volts to initiate the plasma glow. As the plasma glow expands within the envelope 12, the conductive path between the cathode 14 and the anode 16 is improved and a switcher 36 reduces the current to the cage 18 and permits current to flow between cathode 14 and anode 16 due to the potential difference of 130 to 160 volts. The plasma glow achieves a maximum at the set current limit and the lamp is now ready to be used for analysis.

Figure 2:
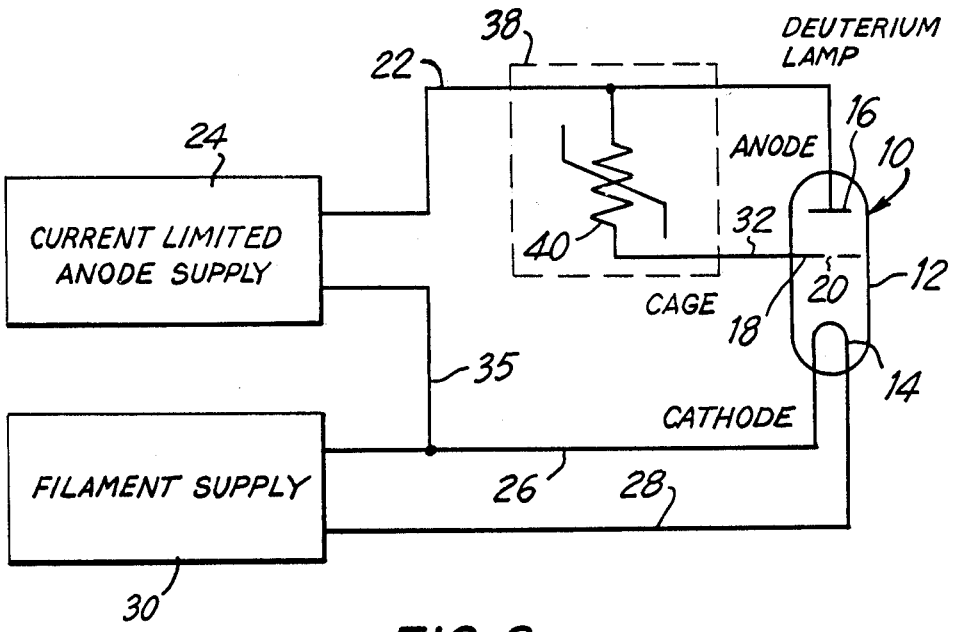
FIG. 2 is a combination block and schematic diagram showing the combined switching and starting circuit, which comprises a metal oxide, voltage dependent resistor (varistor) connected between the anode and the cage of the lamp.
Figure 3:
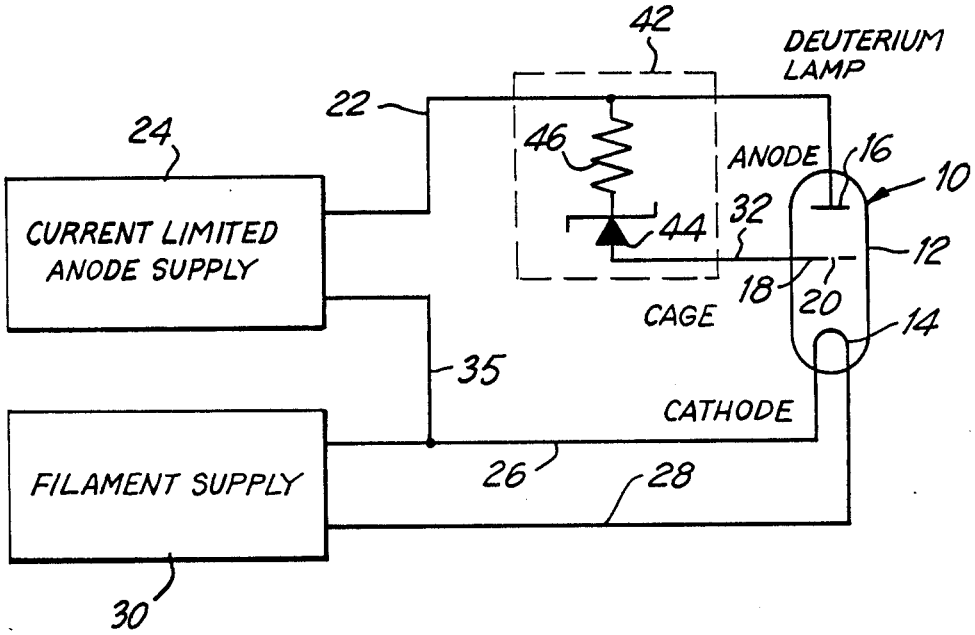
FIG. 3 is a view similar to that of FIG. 2 in which the combined switching and starting circuit comprises a Zener diode and a resistor connected in series.

In FIGS. 2 and 3, there are shown two preferred embodiments of a combined switcher and starting circuit to carry out the teachings of the invention. Let us first examine the operation of the circuit of FIG. 2. A switcher-starter circuit 38 is connected to wires 22 and 32 so that the high positive voltage is applied to an anode 16 and the lower positive voltage is applied to a cage 18. A conductor 35 serves to connect a common lead 26 to the negative terminal of anode supply 24.

Switcher-starter 38 comprises a metal oxide voltage dependent resistor (varistor) 40 electrically connected to anode 16 and cage 18. The high side of switcher-starter 38, which comprises varistor 40, is electrically connected to anode 16 and the low side is electrically connected to cage 18. The output of current limited anode supply 24 is also connected to the high side of switcher-starter 38.

When the filament supply 30 and the anode supply 24 are turned on, there is no electron flow inside the lamp. At this time about 30 volts appears on the cage 18 and a plasma glow initiated by the electron flow between the cathode and the cage appears. As the cage plasma glow increases, the anode plasma glow is initiated by the electron flow between anode 16 and cathode 14. As the anode plasma glow and the current increase, the set anode current limit is reached and the voltage at the anode 16 starts to decrease until a stable condition and the full plasma glow is obtained (approx. 75 to 90 volts). Due to this lower voltage at anode 16 the voltage across the varistor 40 drops below its threshold voltage and current to the cage 18 is reduced appreciably. The anode supply 24 is current limited to prevent the internal lamp current from increasing to a point beyond that necessary to produce full plasma glow. If the anode supply were not so limited, the cathode would evaporate and the lamp would become inoperative.

The circuit of FIG. 3 is similar to that of FIG. 2. Switcher-starter 42 comprises a Zener diode 44 and a current limiting resistor 46 of about 300 ohms or less connected in series. Resistor 46 is connected to the high end of switcher-starter 42 and then to the anode 16. Zener diode 44 is connected to the low end of the switcher-starter and then to the cage 18. When the supplies are first turned on the low positive voltage is connected to the cage 18 and the plasma glow commences. First, the cage-cathode plasma glow is obtained followed by the anode-cathode plasma glow. The anode voltage drops, as the current limit is reached, and the Zener diode 44 stops conducting. The current to the cage 18 is reduced appreciably and the full current is applied to anode 16 to thereby achieve full plasma glow.

The switcher-starter circuits shown in FIGS. 2 and 3 may be incorporated on the power supply chassis as indicated diagrammatically in FIG. 1 or they may be mounted on the lamp's conducting wires as illustrated in FIGS. 4 through 7. The small sizes of the circuit elements permit either location.

Figure 4:
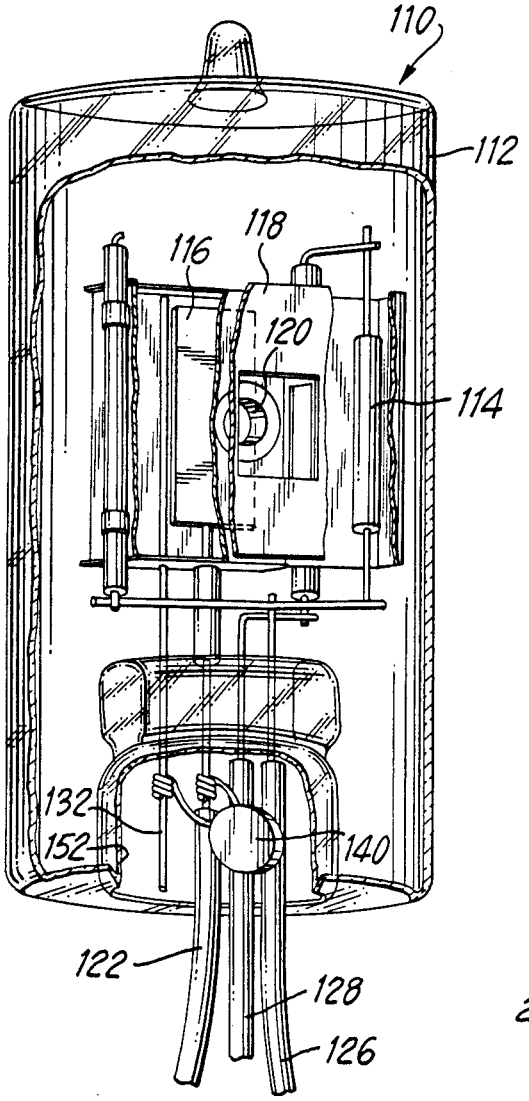
FIG. 4 is a view of a deuterium lamp, partly broken away, showing the combined switching and starting circuit of FIG. 2 connected to the anode and the cage.

In FIG. 4 there is shown, generally, a lamp 110 having an envelope 112, a cathode 114, an anode 116 and a cage 118. A varistor 140 is mounted and secured on wires 122 and 132 which are connected to anode 116 and cage 118, respectively. Envelope 112 is provide with a cup 152 which is a part of the envelope 112. When all of the parts and connecting wires are in place and all of the necessary tests have been made, the cup 152 is filled with silicone rubber or a similar material so that movement of the parts is precluded.

Figure 5:
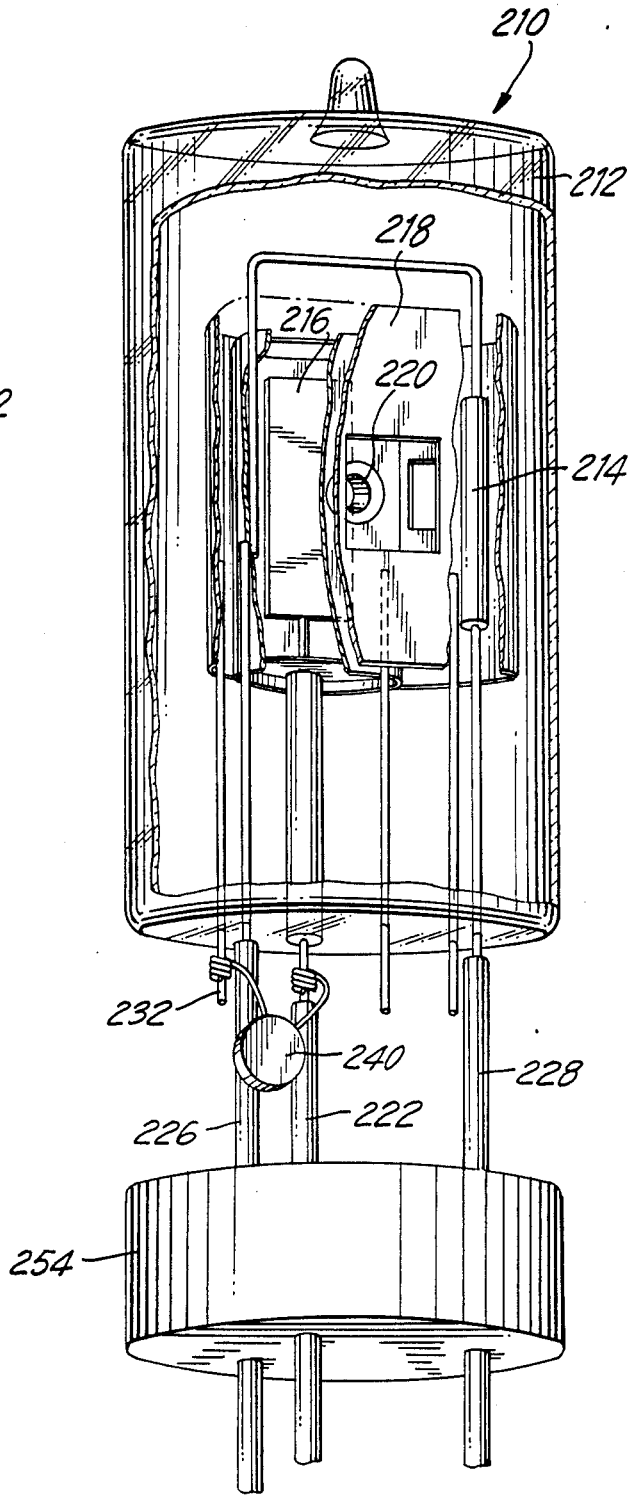
FIG. 5 is a view similar to that of FIG. 4 showing a slightly different lamp construction with the varistor connected between the lamp's anode and the cage.

In FIG. 5 a lamp 210 is shown to comprise an envelope 212, an anode 216, a cathode 214, and a cage 218. A varistor 240 is connected to the anode 216 through wire 222 and to the cage 218 through wire 232. A cap 254 is provided to be moved up to contact envelope 212 and to be cemented thereto after all the necessary tests have been made. Expoxy and cement may be used to hold all the parts under the cap 254 in place and free of breakage in normal use.

Figure 6:
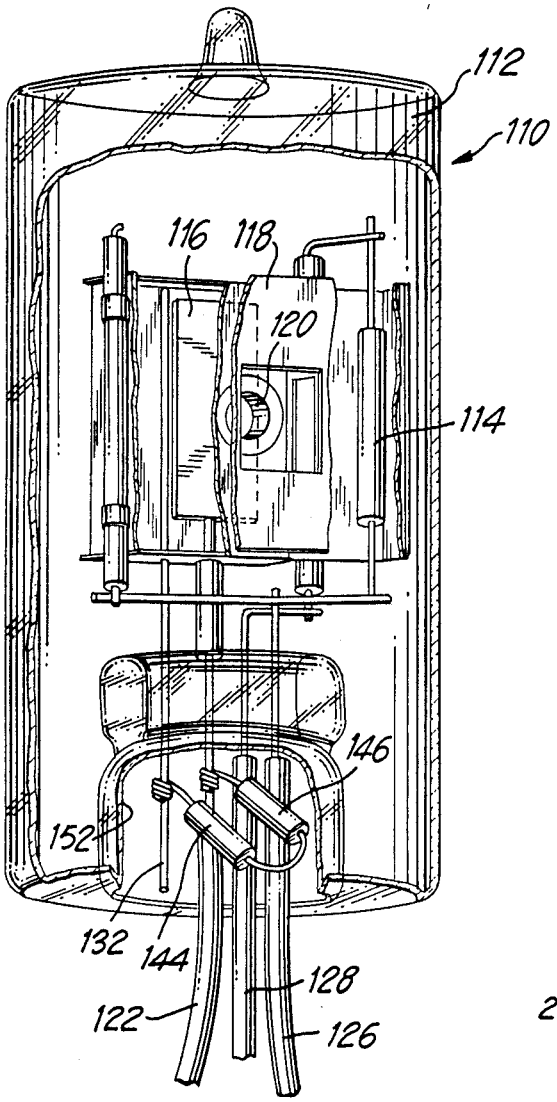
FIG. 6 is a view of the lamp of FIG. 4 showing a Zener diode and a resistor connected in series between the anode and the cage.
Figure 7:
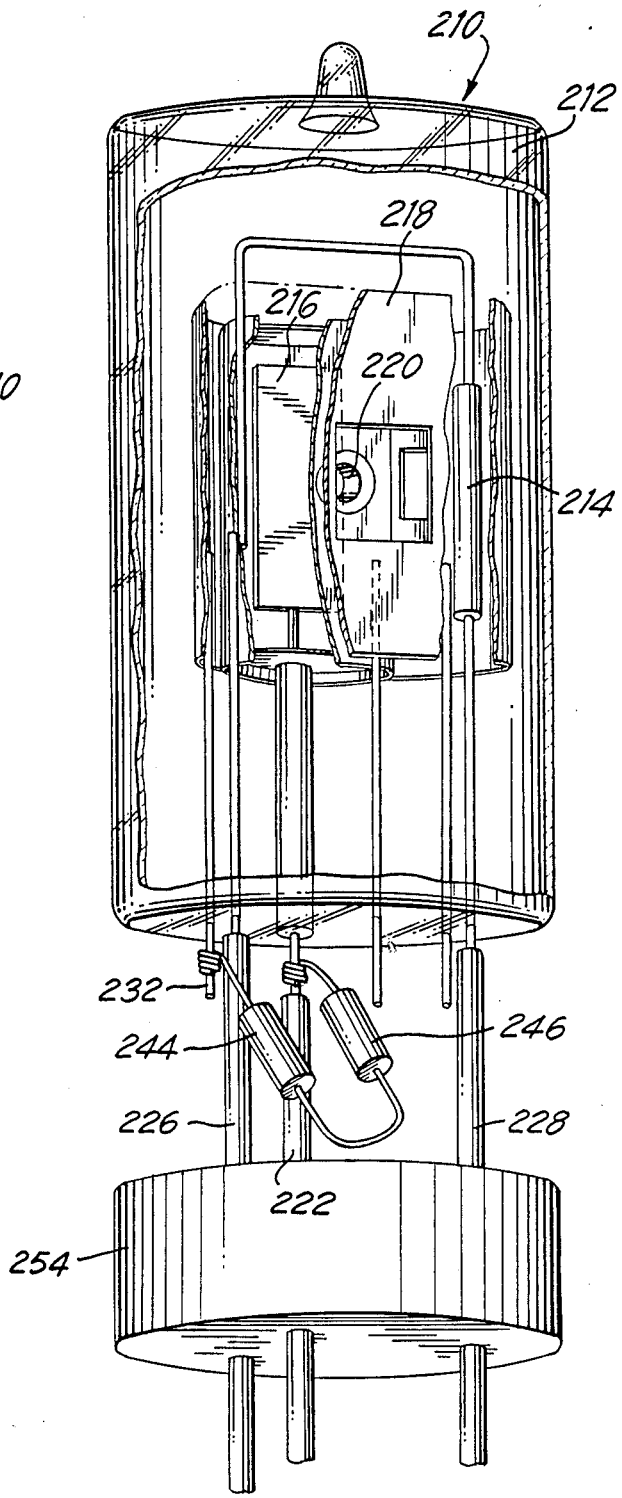
FIG. 7 is a view of the lamp of FIG. 5 showing a Zener diode and a resistor connected in series between the anode and the cage.

FIGS. 6 and 7 are similar to FIGS. 4 and 5. A Zener diode 144 (FIG. 6) is connected to wire 132 and thence to cage 118 and a resistor 146 in series with Zener diode 144 is connected to wire 122 and anode 116. Cup 152 may be and usually is filled with silicone rubber or similar material when all tests are completed.

In FIG. 7, a Zener diode 244 is connected to wire 232 and then to cage 218. Resistor 246, which is in series with Zener diode 244, is connected to wire 222 and then to anode 216. Cap 254 is moved up into contact with envelope 212 after all tests have been completed. Epoxy and cement may be used to keep the elements in place.

It is also possible to use a Zener diode without the series resistor. The series resistor serves to limit changes in current such as spikes from being applied to the Zener diode and damaging it.

There are three significant advantages to the invention: first, the system heater and anode voltages may be turned on simultaneously without the use of delay circuits; second, safety is improved because the low 120 to 160 V starting voltage is used; and third, the aperture may be made smaller than those of the prior art to a diameter of about 0.5 mm or less requiring only up to 160 V to start operation. The prior art lamps require a starting anode voltage of about 400 to 700 volts. Lamps used with the circuits of the present invention will start at voltages as low as 120 volts.

Thus, it can be seen that the invention performs two useful functions: first, the cage serves as a starting electrode to thereby permit the required initial anode voltage to be low; and second, the point source of the ultraviolet is made smaller because the aperture in the cage may be smaller in diameter. It is important for the current in the cage-to-cathode circuit in the lamp to be reduced appreciably as soon as the arc is struck between the cathode and the anode. If this does not occur, sputtering and other spurious effects will occur which will produce inaccuracies and, quite possibly, will destroy the lamp elements.

It will be apparent that the invention is not limited to the embodiments set forth in the description and the drawing and that variations may be made in form and construction without departing from the spirit of the invention as defined in the appended claims.

The embodiments of the invention, in which an exclusive property or privilege is claimed, are defined as follows:

1. In voltage supply means for a deuterium lamp having a gas-filled, enclosed envelope and at least three elements mounted in said envelope, namely, a cathode, an anode and a cage positioned between the anode and the cathode and heating means associated with the cathode, said cage having an arc defining aperture therein, there being at least four conductors extending from inside the envelope to the outside thereof, two of which are connected to the cathode heating means, one of which is a common, the third of which is connected to the anode and the fourth of which is connected to the cage, said voltage supply means having a two-terminal first output means for supplying voltage to the cathode heating means and second output means for supplying anode voltage to the anode, the improvement comprising:

a switching circuit connected between the anode and the cage;

said switching circuit comprising means for applying a low positive voltage to the cage to cause an arc to strike between the cathode and the cage to initiate a plasma glow and to reduce the current to the cage as the anode glow is accelerated and the full anode current is reached.

2. The invention of claim 1 wherein the switching circuit is connected between the third and fourth conductors of the lamp.

3. The invention of claim 2 wherein the switching circuit comprises a metal oxide, voltage dependent resistor (varistor).

4. The invention of claim 2 wherein the switching circuit comprises a Zener diode.

5. The invention of claim 4 including a resistor connected in series with the Zener diode.

6. The invention of claim 1 wherein:

the switching circuit is connected between the common terminal of the voltage supply means and the anode terminal of the voltage supply means;

the voltage supply means having a further terminal connected to the low positive-voltage end of the switching circuit;

said low positive-voltage terminal being connected to the fourth conductor extending outside the lamp envelope.

7. The invention of claim 6 wherein the switching circuit comprises a metal oxide, voltage dependent resistor (varistor).

8. The invention of claim 6 wherein the switching circuit comprises a Zener diode.

9. The invention of claim 8 including a resistor connected in series with the Zener diode

10. A deuterium lamp and a circuit therefor comprising:

a cathode, a heater for said cathode, an anode and a conductive cage placed between the cathode and the anode;

said cathode heater, anode and cage being enclosed in a gas-filled envelope;

two terminal wires projecting through the envelope from the heater;

a terminal wire projecting through the envelope from the anode;

a terminal wire projecting through the envelope from the cage;

said cage having an aperture therein; and means connecting the anode and the cage to a switching means, said switching means providing means for supplying a current limited voltage to the cage when no current flows between the cathode and the anode, such that current flows between the cathode and the cage to produce a plasma glow therebetween, and means for reducing the current between the cage and the cathode when the current flow between the anode and the cathode reaches the current limit determined by the means for supplying a current limited voltage to thereby produce a full plasma glow in the lamp.

11. The invention of claim 10 wherein the switching means comprises a metal oxide, voltage dependent resistor.

12. The invention of claim 10 wherein the switching means comprises a Zener diode.

13. The invention of claim 12 including a resistor connected in series with the Zener diode.

* * * * *